US005211364A

United States Patent [19]

James

[11] Patent Number: 5,211,364

[45] Date of Patent: May 18, 1993

[54] SUPPORT DEVICE FOR RECREATIONAL WATER BOARD

[76] Inventor: Michael W. James, 204 W. Mission Ct., Corona, Calif. 91720

[21] Appl. No.: 763,962

[22] Filed: Sep. 23, 1991

[51] Int. Cl.[5] ..... B63B 17/00

[52] U.S. Cl. ..... 248/156; 248/85; 248/185; 441/74

[58] Field of Search ..... 248/156, 533, 545, 530, 248/532, 85-88, 76, 166, 435, 185, 96, 176, 177; 211/29; 441/74; 114/343

[56] References Cited

U.S. PATENT DOCUMENTS 1,046,033 12/1912 Smith ..... 248/88
1,443,230 1/1923 Luckett ..... 248/156 X
2,531,867 11/1950 Wurdinger ..... 248/87 X
3,473,770 10/1969 Edgerton ..... 248/156 X
3,858,833 1/1975 Fink ..... 248/530 X
3,876,970 4/1975 Schweitzer ..... 248/156 X
3,921,329 11/1975 Looby et al. ..... 248/530 X
5,069,406 12/1991 Colyer et al. ..... 441/74

*Primary Examiner*—Karen J. Chotkowski

[57] ABSTRACT

A supporting device for a recreational water board to support the board along a generally vertical plane with an edge of the board resting on a swimming beach or other generally horizontal surface, said device comprising an elongated support element to be inserted into the ground or sand and a pair of arms which are pivotally mounted on the support element to be pivoted between a storage or transport position and an operating position.

5 Claims, 1 Drawing Sheet

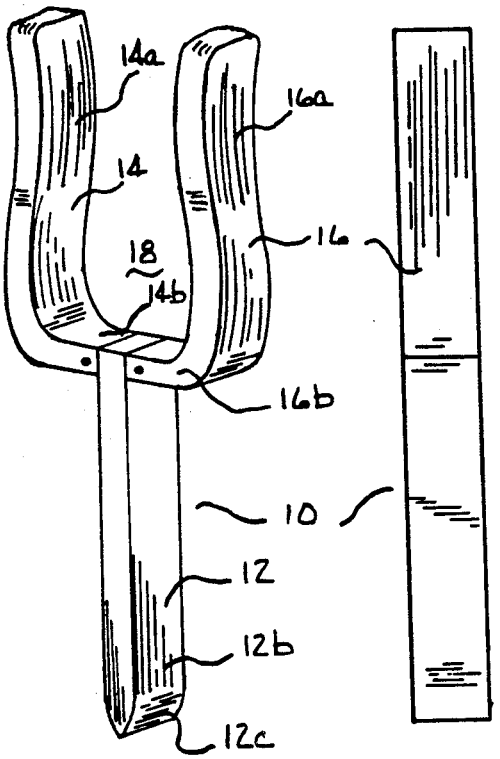
FIGURE 1
FIGURE 2
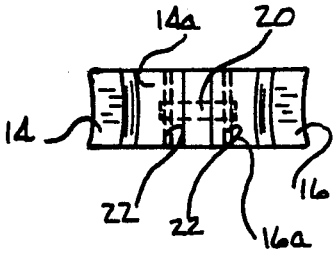
FIGURE 3
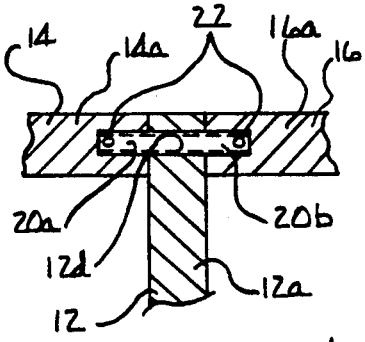
FIGURE 4
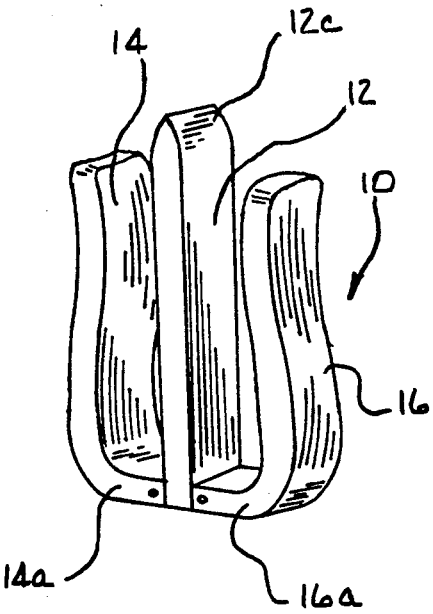
FIGURE 5
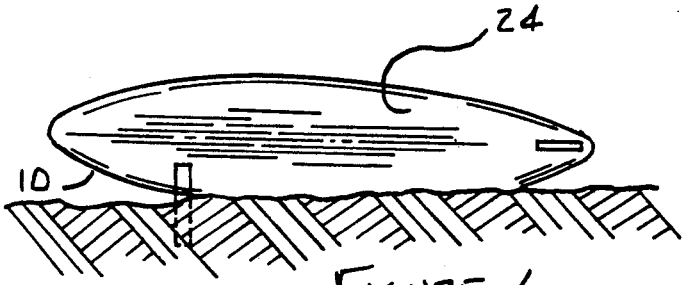
FIGURE 6
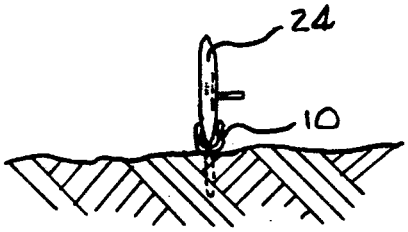
FIGURE 7

SUPPORT DEVICE FOR RECREATIONAL WATER BOARD

The present invention relates generally to support devices for supporting a recreational water board, but more particularly to a support device which will support or retain a recreational water board in a generally vertical position along a single edge thereof.

BACKGROUND OF THE INVENTION

As is well realized, there are many different styles and configurations of recreational water boards such as surfboards, boogie boards, sailboards and the like, which are used for recreational purposes in either floating on a very large body of water or for moving through the water, as the case may be. The instant invention is equally applicable to these various different types and kinds of recreational water boards, and enables the boards to be supported or positioned in a prescribed manner.

With most, if not all recreational water boards, it is frequently desirable to apply a coating of wax or other appropriate material to the top or bottom or both such surfaces in order to enable the user to firmly stand on one surface and to enhance the board's ability to easily and smoothly move through the water. Such wax as applied to the top or bottom surface of a water board, makes such surface tacky or sticky. If the waxed surface then comes in contact with loose sand or other materials on the beach, it becomes very rough and undesirable. Further, such foreign material is very difficult to remove because the wax necessarily is made to be impervious to water so as to not dissolve therein. Thus, if the board is haphazardly laid on the sand beach, considerable work is required to return the board to its desired smooth condition.

OBJECTS OF THE INVENTION

In view of the foregoing, it is an object of the present invention to provide a support device for recreational water boards of various types and descriptions whereby the board can be supported in a generally vertical plane along an edge thereof.

Another object of the present invention is to provide a support device for recreational water boards as characterized above wherein the water board is supported along an edge of the board which is usually not waxed.

Another object of the present invention is to provide a support device as characterized above which can be easily inserted in the sand or ground at a swimming beach to support the board in its proper position.

Another object of the present invention is to provide a support device as characterized above which comprises a pair of support arms forming a cradle for the board, such arms being pivotally retractable so that the support device is of a size to be easily transported and stored.

A still further object of the present invention is to provide a support device a characterized above which is simple and inexpensive to manufacture and which is rugged and dependable in operation.

BRIEF DESCRIPTION OF THE DRAWINGS

The novel features which I consider characteristic of my invention are set forth with particularity in the appended claims. The invention itself, however, both as to its organization and mode of operation, together with additional objects and advantages thereof, will best be understood from the following description of specific embodiments when read in combination with the accompanying drawings, in which:

FIG. 1 is a perspective view of a support device according to the present invention;

FIG. 2 is a side elevational view of the support device of FIG. 1;

FIG. 3 is a top plan view of such support device;

FIG. 4 is a fragmentary sectional view taken substantially along line 4—4 of FIG. 3 of the drawings;

FIG. 5 is a perspective view of the subject support device in its retracted or collapsed condition;

FIG. 6 is a sectional view showing a water board supported by the subject device; and FIG. 7 is an end elevational view of the board and support device of FIG. 6.

Like reference characters indicate corresponding parts throughout the several views of the drawings.

DESCRIPTION OF THE PREFERRED EMBODIMENT

Referring to FIG. 1 of the drawings, there is shown therein a support device 10 according to the present invention. Device 10 comprises an elongated support element 12 and a pair of support arms 14 and 16, such arms being mounted on end 12*a* of support element 12 to form a generally U-shaped cradle 18.

As will be readily apparent to those persons skilled in the art, the element 12 and arms 14 and 16 may be formed of any suitable strong material such as steel, aluminum or very heavy and durable plastic.

Support element 12, in addition to the end portion 12*a*, is also formed with an end portion 12*b*, the marginal end 12*c* of which is formed with a tapered point so that the element 12 can be readily inserted into the sand, gravel or ground of which a swimming beach may be formed.

Each of the support arms 14 and 16, as shown particularly at 14*a* and 16*a*, respectively, are curved so as to provide, as will hereinafter be more readily apparent, a relatively large area of contact on each of the arms 14 and 16 against a water board. Such large area is necessary to prevent injury to a board placed in the subject support device.

Each of arms 14 and 16 is formed with an end portion 14*b* and 16*b* which, as shown in FIGS. 3 and 4, is formed with an opening 14*c* and 16*c*, respectively, to receive the opposite ends 20*a* and 20*b* of a pivot pin 20. Such pin 20 extends through a through opening 12*d* formed in the end portion 12*a* of element 12. The pin 20 is held in fixed position within arms 14 and 16 by anchor pins 22 which are fixed in appropriate openings in end 14*b* and 16*b*.

For ease of transport and storage, as shown in FIG. 5 of the drawings, the support device 10 can be converted to its compact condition. In this position, the arms 14 and 16 are parallel to and generally adjacent to the support element 12. To place it in its operating position, it is merely necessary to rotate the arms 14 and 16 on the end portion 12*a* of element 12 to the position shown in FIGS. 1 and 2. Although it is possible to utilize more elaborate pivotal apparatus to firmly secure the arms in their operating position, it has been found that since most of the weight of the water board will be at right angles to the direction of pivot motion of the arm on the support element, the support device can be expected to remain in its operating position throughout its normal use.

While in its operating condition, the support device 10 can be anchored in the ground by inserting the element 12 in the sand, dirt or crushed rock of which the beach is formed. When so positioned, the water board shown at 24 in FIGS. 6 and 7 can be positioned within the cradle 18 with the board in a generally vertical plane with an edge of the board resting on the beach. In this in-use position, the top and bottom surfaces of the board are retained away from the sand or other material on the beach. In fact, it has been discovered by surfers and other users of water boards that the vertically positioned board can provide a sun or wind screen for the resting or sleeping athlete.

As will be readily apparent, to remove the board, it is merely necessary to lift the board 24 from the cradle 18 and thereafter to retract the support element 12 from the sand or other beach surface. The support device 10 can then be positioned as shown in FIG. 5 for ease in transport as well as storage.

Although I have shown and described certain specific embodiments of my invention, I am well aware that many modifications thereof are possible. The invention, therefore, is not to be restricted except insofar as is necessitated by the prior art and by the spirit of the appended claims.

I claim:

1. A support device and recreational water board in combination, comprising:

an elongated support element having an end portion with a means for inserting in the ground;

a means forming a cradle comprising a pair of S-shaped arms each pivotally attached at a respective lower end to the uppermost end of the elongated support element, wherein a side edge of said water board is positioned in the means forming a cradle and defining an operating position wherein the S-shaped arms engage respective top and bottom surfaces of the water board, holding the board in a generally vertical plane when the means for inserting is disposed in the ground.

2. Support device according to claim 1 wherein said means further includes a lost motion connection between said cradle and said support element whereby said device can be reduced in size for storage and transport.

3. Support device according to claim 2 wherein said lost motion connection includes a pivot pin between said support element and each of said arms.

4. Support device according to claim 3 wherein said pivot pin is secured to each of said arms and extends through an opening in said support element.

5. Support device according to claim 4 wherein said pivot pin enables each of said arms to pivot on said support element from a storage position adjacent said element to an operating position extended from said element.

* * * * *